US006286279B1

(12) United States Patent
Bean et al.

(10) Patent No.: US 6,286,279 B1
(45) Date of Patent: Sep. 11, 2001

(54) METHOD FOR ATTACHING FABRIC AND FLOOR COVERING MATERIALS TO CONCRETE

(76) Inventors: Dennis L. Bean, deceased, late of Vicksburg, MS (US), by Patricia Bean; Philip G. Malone, 107 Fox Run La., Vicksburg, MS (US) 39180; Andries D. Sebastian, 1522 Ridge Point Rd., Hixson, TN (US) 37343

( * ) Notice: Subject to any disclaimer, the term of this patent is extended or adjusted under 35 U.S.C. 154(b) by 0 days.

(21) Appl. No.: 09/229,161

(22) Filed: Jan. 13, 1999

(51) Int. Cl.[7] ..... E04F 15/02

(52) U.S. Cl. ..... 52/390; 52/391; 52/411; 52/745.21; 52/746.1

(58) Field of Search ..... 52/390, 391, 408, 52/411, 745.21, 746.1; 248/679, 346.01

(56) References Cited

U.S. PATENT DOCUMENTS

| | | | | |
|---|---|---|---|---|
| 1,429,740 | * | 9/1922 | Jordan | 52/411 |
| 2,036,123 | * | 3/1936 | Dahlander | 52/411 |
| 3,348,348 | * | 10/1967 | Perez | 52/391 |
| 3,451,884 | | 6/1969 | Anno et al. . | |
| 3,586,598 | | 6/1971 | Beemer . | |
| 3,900,102 | | 8/1975 | Hurst . | |
| 4,112,176 | | 9/1978 | Bailey . | |
| 4,131,703 | | 12/1978 | Voet . | |
| 5,052,161 | * | 10/1991 | Whitacre | 52/385 |
| 5,137,764 | * | 8/1992 | Doyle et al. | 428/44 |
| 5,286,318 | | 2/1994 | Sims et al. . | |
| 5,633,064 | | 5/1997 | Ragland et al. . | |
| 5,645,664 | | 7/1997 | Clyne . | |
| 5,658,430 | | 8/1997 | Drake, Jr. et al. . | |

* cited by examiner

*Primary Examiner*—Beth A. Stephan
*Assistant Examiner*—Brian E. Glessner

(57) ABSTRACT

A method of attaching a covering material, such as carpeting, to a concrete surface, includes applying a first adhesive over a concrete surface, providing a steel barrier including a plurality of projections extending from the bottom surface thereof, pressing the steel barrier over the adhesive such that the projections are embedded therein, and bonding the covering material over the barrier. The moisture-proof barrier construction of the present invention includes a concrete layer, a steel barrier, which is adhesively mounted to the concrete layer and includes a plurality of projections extending from the bottom surface thereof that are embedded into an adhesive between the concrete layer and the steel barrier. The barrier includes a covering material which is adhesively mounted on the steel barrier. The invention provides an effective technique for attaching a covering material, such as carpeting to a concrete surface, that prevents failing of the adhesive bonding between the covering material and the concrete surface.

19 Claims, 1 Drawing Sheet

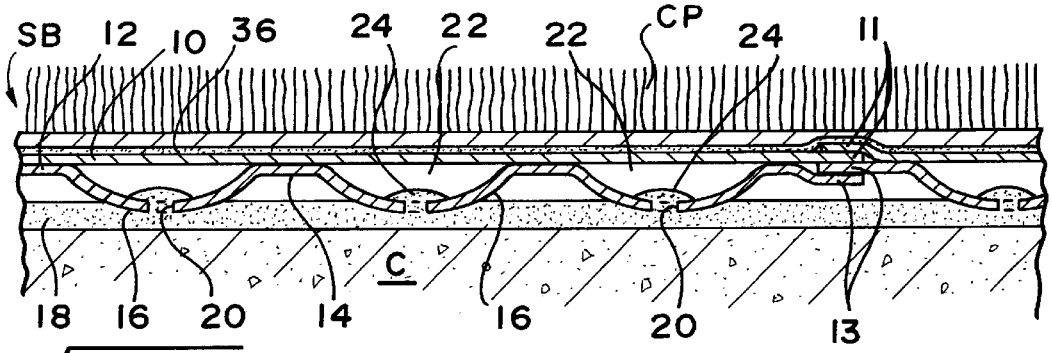
FIG. 1
FIG. 2
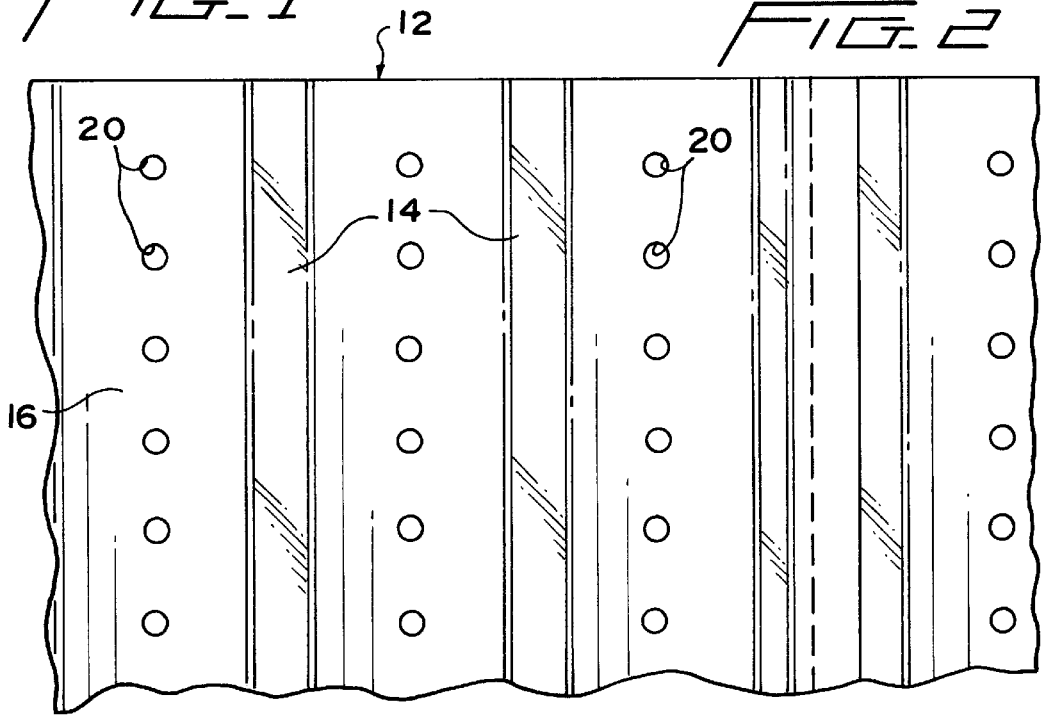
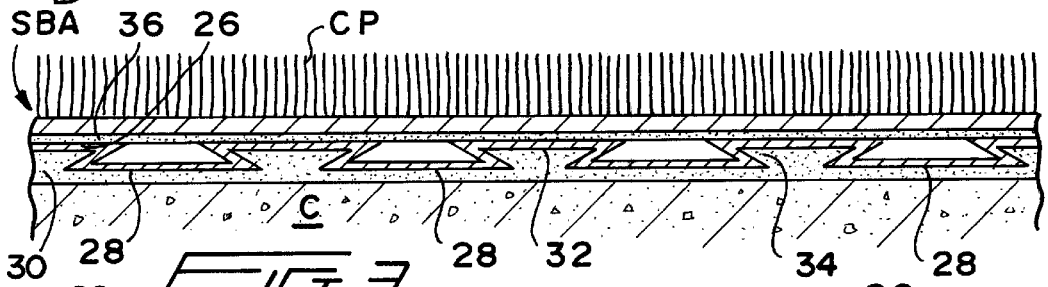
FIG. 3
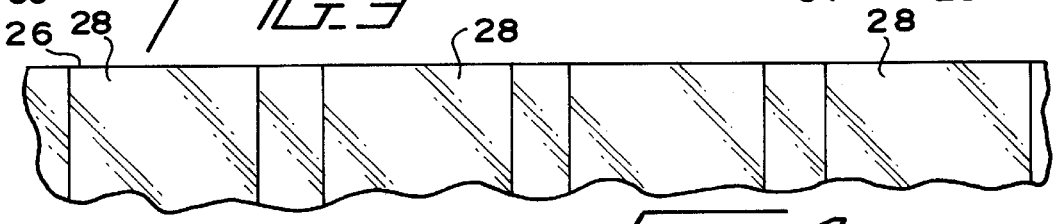
FIG. 4

METHOD FOR ATTACHING FABRIC AND FLOOR COVERING MATERIALS TO CONCRETE

FIELD AND HISTORICAL BACKGROUND OF THE INVENTION

The present invention is directed to a method of attaching a covering material to a concrete surface. More particularly, the present invention is directed to a method of attaching fabric and floor covering materials, such as carpet, to concrete.

Attaching fabric or carpeting to a concrete surface presents problems since the concrete can transmit moisture to the surface where the adhesive bonds with textile material to the concrete. The moisture and alkalinity of the is concrete degrades the adhesive and causes the bond to fail and thus, the carpet becomes free from the concrete. Conventional techniques include using chemical sealants to prevent the movement of moisture out of the concrete. This technique, however, has not been found to be very effective. Various examples of attaching floor coverings to concrete surfaces and the like are disclosed in U.S. Pat. Nos. 3,451,884; 3,586,598; 3,900,102; 4,112,176; 4,131,703; 5,286,318; 5,658,430; 5,633,064; and 5,645,664.

In particular, U.S. Pat. No. 3,451,884 to Anno et al. discloses a waterproof pile coated sheet for laminating which includes a film base of a substance with asbestos piles extending into and embedded in the film. A hydraulic cement layer can be connected to the sheet through the intermediary of the asbestos piles.

U.S. Pat. No. 3,586,598 to Beemer is directed to a carpet floor covering and method. The invention is directed to the covering of floors, and more particularly, to a method of adhering cellular elastomer cushion-backed carpet to floors.

U.S. Pat. No. 3,900,102 to Hurst is directed to a preformed, flexible sheet-like structure suitable for application to concrete as a waterproofing structure.

U.S. Pat. No. 4,112,176 to Bailey is directed to a polyurethane ground rubber composite for use in surfacings and the like and a method for formation and preparation thereof.

U.S. Pat. No. 4,131,703 to Voet is directed to a fire-resistant construction and method of making same wherein the construction comprises a cellular layer of an elastomeric material and a sheet of metallic foil fixed against the layer.

U.S. Pat. No. 5,286,318 to Sims et al. is directed to a method of forming an EMI shielded load bearing floor for an EMI shielded enclosure.

U.S. Pat. No. 5,658,430 to Drake, Jr. et al. is directed to a method of installing new wall-to-wall carpeting at a location in which there exists a worn wall-to-wall carpeting.

U.S. Pat. No. 5,633,064 to Ragland et al. is directed to a lightweight and resilient heat barrier, and sound and vibration dampening laminate.

U.S. Pat. No. 5,645,664 to Clyne is directed to a method of applying a high moisture permeability floor covering material to a concrete surface and product thereof.

There is, however, a need in the industry for a method of attaching a covering material, such as carpeting, to a concrete surface, which effectively prevents the adhesive bonding, between the carpet and the concrete floor, from failing.

OBJECTS AND SUMMARY OF THE INVENTION

The principal object of the present invention is to provide a method of attaching a covering material to a concrete surface which does not suffer from the disadvantages associated with the conventional techniques.

Another object of the present invention is to provide a method of attaching a covering material to a concrete surface which prevents the adhesive bonding between the covering material, such as carpeting, and the concrete from failing.

Yet another object of the present invention is to provide a method of attaching a covering material to a concrete surface which prevents permeation of moisture from the concrete to the adhesive bonding area.

Still yet another object of the present invention is to provide a method of attaching a covering material to a concrete surface which utilizes a steel foil or plate layer, as an effective vapor barrier, that protects the adhesive beneath the carpet from the moisture which moves through the concrete.

An additional object of the present invention is to provide a method of attaching a covering material to a concrete surface which solves the problem of bonding textile materials to concrete, and further provides a useful solution for a variety of moisture-sensitive materials, such as vinyl, wood, pressed boards.

Yet an additional object of the present invention is to provide a method of attaching a covering material to a concrete surface which protects the concrete and the covering material from premature weathering and provides a surface for paint or spray-on coatings. The use of a steel foil or barrier makes it possible to use coatings that are not generally compatible with concrete. In this regard, tin-plated steel and stainless steel both have proved useful for use in this invention. These materials are further useful in that they can be cleaned easily.

Still yet an additional object of the present invention is to provide a method of attaching a covering material to a concrete surface which uses a steel foil or plate as a barrier which can be useful in attaching almost any covering material, and particularly, the moisture-sensitive covering materials, to concrete.

Another object of the present invention is to provide a construction which includes the above-noted objects and advantages and, in particular, prevents failing of the adhesive bonding between the covering material, such as carpeting, and the underlying substrate, such as concrete.

In summary, the main object of the present invention is to provide a method of attaching a covering material, such as carpeting, to a concrete surface, which includes applying a first adhesive over a concrete surface, providing a steel barrier including a plurality of projections extending from the bottom surface thereof, pressing the steel barrier over the adhesive such that the projections are embedded therein, and bonding the covering material over the barrier. The moisture-proof barrier construction of the present invention includes a concrete layer, a steel barrier, which is adhesively mounted to the concrete layer and includes a plurality of projections extending from the bottom surface thereof that are embedded into an adhesive between the concrete layer and the steel barrier. The barrier includes a covering material which is adhesively mounted on the steel barrier. The invention provides an effective technique for attaching a covering material, such as carpeting to a concrete surface, that prevents failing of the adhesive bonding between the covering material and the concrete surface.

BRIEF DESCRIPTION OF THE DRAWINGS

The above and other objects, novel features and advantages of the present invention will become apparent from the following detailed description of the invention illustrated in the accompanying drawings, in which:

FIG. 1 is a vertical cross-sectional view of a concrete surface having a covering material attached thereto according to the present invention;

FIG. 2 is a bottom plan view of the of the construction shown in FIG. 1;

FIG. 3 is an alternative embodiment of the invention shown in FIG. 1; and FIG. 4 is a bottom plan view of the construction shown in FIG. 3.

DETAIL DESCRIPTION OF THE INVENTION

The present invention uses a thin deformed steel plate or steel foil, or multiple layers of foil, bonded between a concrete surface and the textile to provide a water vapor barrier.

In one embodiment, the steel plate or foil is folded or stamped to form protrusions that embed themselves in a Portland cement-based adhesive. The protrusions form a mechanical bond that augments the chemical bond that occurs between the Portland cement-based adhesive and the steel. In another embodiment, the steel or steel foil barrier can be made in two layers, a lower perforated layer and an upper unperforated layer. The layers are bonded together by welding, soldering, brazing, or gluing. The Portland cement-based adhesive moves through the perforations and provides a chemical bond and a mechanical anchor between the double foil or plate layer and the concrete below the adhesive.

The steel plate is bonded to the concrete using a Portland cement-based adhesive that does not degrade in the presence of moisture and alkalinity. The steel acts as a moisture barrier so that a variety of adhesives can be used to bond the carpet or textile to the steel surface without being affected by the concrete. This approach offers a number of advantages over techniques that are currently being used. The advantages include:

1. The steel foil layer is a very effective vapor barrier that can protect the adhesive beneath the carpet from moisture moving through the concrete;

2. Materials leaking through the carpet or textile cannot degrade the surface of the concrete;

3. Heat and static electrical charges can be dissipated by the steel foil;

4. The steel foil layer can be made a continuous barrier by overlapping, crimping, or welding sections of foil;

5. The steel foil can be used on vertical, horizontal, or sloping surfaces; and

6. The ductility of the steel foil allows the barrier to stretch as the underlying concrete cracks and moves.

In order to use steel foil as a carpet or textile underlying material, it was necessary to develop an adhesive that could be used to bond the steel foil to the surface of the concrete. The adhesive paste is made by adding water to a mixture containing Portland cement, a fine aggregate (such as agricultural lime or ground quartz sand), silica fume, and a commercial high-range water reducer. The components are mixed to form a smooth paste.

An example formulation for the Portland cement-based adhesive is given in Table 1. This formulation uses ground limestone as a fine aggregate, but ground quartz would work well.

TABLE 1

Proportioning of Portland Cement-based Adhesive

| Mixtures | Relative Proportion by Volume | Relative Proportion By Mass |
|---|---|---|
| Cement (Portland Types I-II) | 1 | 2,000 g |
| Lime (Agricultural lime) | 1 | 1,400 g |
| Silica fume | 0.0 | 144 g |
| Water | 0.8 | 800 g |
| High-Range Water Reducer* | — | 15 g |

*Product such as Daxad-19, available from Grace Concrete Products, Cambridge, MA.

The concrete surface to be covered is cleaned with a 10 percent hydrochloric acid solution and thoroughly washed. The surface is saturated with clean water and the Portland cement-based paste is spread over the concrete.

The foil is spread out on the cleaned surface and is pressed into the paste. The bond with the steel foil forms as the Portland cement hydrates. The time required for a strong bond to form may vary from hours to days depending on the type of cement employed and the addition of set accelerators, such as calcium nitrate.

After the steel foil is installed, carpet or fabric can be bonded to the steel surface using a variety of adhesives, including silicone rubber, latex, or epoxy. A suitable carpet adhesive for use in bonding carpet to the steel foil is Advance Airtech Universal Multi-purpose AD-hesive 675, available from Advanced Airtech Adhesives, Inc., Dalton, Ga.

The adhesive will be unaffected by the moisture and the concrete because the upper foil layer is a continuous barrier that prevents the moisture from the concrete from affecting the material above it.

A multilayer steel barrier of the invention has been produced to provide a mechanical attachment of the foil covering or cladding using two layers of foil. The mechanical attachment assures that the covering remains on the concrete under thermal stress or impact of traffic over the foil-clad concrete surface. As shown in FIG. 1, a two-layered steel foil covering or cladding SB is used. The barrier SB includes an upper layer 10 and a lower layer 12. The lower layer 12 is discontinuously attached to the upper layer 10 at top sections 14 and includes bottoms sections or projections 16 that come in contact with an adhesive 18. (The lower layer 12 may alternatively be attached to the upper layer 10 by spot or strip welding.) Preferably, the lower layer 12 is larger than the upper layer 10, and is pulled into the same size as the upper layer 10.

As best shown in FIGS. 1 and 2, the bottom sections 16 include perforations 20 to allow the adhesive 18 (the Portland cement-based adhesive mixture) to move or flow therethrough and into spaces 22 between the upper and lower layers 10 and 12. As the adhesive 18 cures and hardens, upwardly extending projections 24 of the adhesive are formed into spaces 22 to mechanically anchor the barrier SB to the concrete C. As best shown in FIG. 1, the free ends 11 and 13 of the upper and lower layers 10 and 12, respectively, are interleaved to form a larger, continuous barrier covering.

An alternative embodiment of the steel barrier SBA is disclosed in FIGS. 3 and 4. As shown, a single layer of steel foil (or plate) 26, is folded without perforating it to produce "pleat-like" downwardly extending projections 28 that are pressed into the underlying adhesive 30 to mechanically anchor the barrier SBA to the concrete C. The adhesive forms a chemical bond with the barrier SBA. Further, the adhesive 30 moves between the projections or pleats 28 and the lower surface 32 of the plate 26, to form anchor portions 34 that, upon curing or hardening, mechanically hold the plate 26 to the concrete C.

Once the steel barrier plate or foil SB (or SBA) is anchored or secured over the concrete C, carpet or textile material CP is secured o the steel barrier plate by using a carpet-laying adhesive 36.

It is noted herewith that although steel is considered to be the best choice for making the barrier of invention, other metal materials, such as copper, aluminum, may also be used. It is further noted herewith that while the invention has been described in terms of concrete as the base substrate layer to which a covering material is attached, the invention is not limited to concrete and other similar substrate material are considered to be within the scope of the invention.

The steel foil barrier of the invention has a number of advantages for attaching textile materials to concrete. For example:

1. Steel has been recognized to form a strong, reliable bond with concrete (no other metal foil works as well as steel);

2. Steel foil can form a durable, easily inspected vapor-tight layer;

3. The surface of the formed steel foil can be embossed or roughened to improve bonding to the concrete and the carpet;

4. The steel foil can be made into a continuous barrier by welding or folding and crimping the edges of adjacent strips;

5. The steel foil can be installed on vertical, horizontal and sloping surfaces;

6. Steel foil is ductile. It will stretch when the concrete under the foil cracks and moves;

7. If damaged, the steel foil can be easily patched by welding or bonding a replacement piece after removing the damaged foil; and 8. The steel foil can protect the concrete from materials leaking from the carpet or fabric covering.

While this invention has been described as having preferred designs, it is understood that it is capable of further modifications, uses and/or adaptations following in general the principle of the invention, and including such departures from the present disclosure as those come within the known or customary practice in the art to which the invention pertains, and as may be applied to the central features hereinsetforth, and fall within the scope of the invention and the limits of the appended claims.

What is claimed is:

1. A method of attaching a covering material to a concrete surface, comprising the steps of:

a) applying a first adhesive over a concrete surface;

b) providing a steel barrier including a plurality of projections extending from a bottom surface thereof, the steel barrier comprising an upper layer and a lower layer, the upper layer comprising a solid barrier layer for preventing the flow of a material therethrough;

c) pressing the steel barrier over the adhesive such that the projections are embedded therein; and d) bonding a covering material over the barrier.

2. The method of claim 1, further comprising the step of applying a second adhesive over the steel barrier prior to the bonding step d).

3. The method of claim 1, wherein the steel barrier comprises a steel plate.

4. The method of claim 1, wherein the steel barrier comprises a steel foil.

5. The method of claim 1, wherein the lower layer including a plurality of top sections for bonding with the upper layer and a plurality of bottom sections for bonding with the adhesive.

6. The method of claim 5, wherein at least one of the bottom sections includes a perforation extending through the thickness thereof such that the adhesive flows therethrough.

7. The method of claim 1, wherein the projections comprise pleats formed by folding the steel barrier.

8. The method of claim 1, wherein the first adhesive comprises a Portland cement-based adhesive.

9. The method of claim 1, wherein the first adhesive comprises cement, lime, silica, water and a water reducer.

10. The method of claim 2, wherein the second adhesive is selected from the group consisting of silicone rubber, latex and epoxy.

11. The method of claim 1, wherein the bonding step d) comprises bonding a covering material selected from the group consisting of carpet, textile, vinyl, wood and pressed board.

12. A moisture-proof barrier construction, comprising:

a) a concrete layer;

b) a steel barrier adhesively mounted to said concrete layer;

c) said steel barrier including a plurality of projections extending from a bottom surface thereof and embedded into an adhesive disposed between said concrete layer and said steel barrier;

d) the steel barrier comprising an upper layer and a lower layer, the upper layer comprising a solid barrier layer for preventing the flow of a material therethrough; and e) a covering material adhesively mounted on said steel barrier.

13. The barrier construction of claim 12, wherein said steel barrier comprises a steel plate.

14. The barrier construction of claim 12, wherein said steel barrier comprises a steel foil.

15. The barrier construction of claim 12, wherein said lower layer including a plurality of top sections for bonding with said upper layer and a plurality of bottom sections for bonding with the adhesive.

16. The barrier construction of claim 15, wherein at least one of said bottom sections includes a perforation.

17. The barrier construction of claim 12, wherein the projections comprise pleats formed by folding the steel barrier.

18. The barrier construction of claim 12, wherein said covering material comprises a textile material.

19. The barrier construction of claim 12, wherein said covering material comprises one of carpet, vinyl, wood or pressed board.

* * * * *